US007930854B1

(12) United States Patent
Zaverousky et al.

(10) Patent No.: US 7,930,854 B1
(45) Date of Patent: Apr. 26, 2011

(54) ADJUSTABLE HIGH WATER CAPACITY TREE STAND

(76) Inventors: Thomas J. Zaverousky, Antigo, WI (US); Carl L. Messer, Deer Brook, WI (US)

( * ) Notice: Subject to any disclaimer, the term of this patent is extended or adjusted under 35 U.S.C. 154(b) by 493 days.

(21) Appl. No.: 12/157,847

(22) Filed: Jun. 14, 2008

Related U.S. Application Data

(60) Provisional application No. 60/934,758, filed on Jun. 15, 2007.

(51) Int. Cl.
*A47G 33/12* (2006.01)

(52) U.S. Cl. ..... 47/40.5

(58) Field of Classification Search ..... 47/40.5, 47/48.5, 42, 41.12, 41.14, 39; 428/18; D11/130.1; 248/521, 523, 519, 524, 525, 527
See application file for complete search history.

(56) References Cited

U.S. PATENT DOCUMENTS

| | | | | | |
|---|---|---|---|---|---|
| 4,565,028 | A | * | 1/1986 | Stephan | 47/40.5 |
| 4,930,252 | A | | 6/1990 | Krause et al. | |
| 4,967,508 | A | * | 11/1990 | Reynolds | 47/40.5 |
| 4,993,176 | A | | 2/1991 | Spinosa | |
| 5,020,271 | A | | 6/1991 | Walker | |
| 5,157,868 | A | | 10/1992 | Munoz | |
| 5,160,110 | A | * | 11/1992 | Praegitzer | 248/523 |
| 5,369,910 | A | | 12/1994 | Copenhaver | |
| 5,446,993 | A | | 9/1995 | Cullen | |
| 5,473,837 | A | | 12/1995 | Skoczylas et al. | |
| 5,493,277 | A | | 2/1996 | Pierce et al. | |
| 5,513,677 | A | | 5/1996 | McCurry | |
| 6,129,325 | A | * | 10/2000 | Niklas | 248/523 |
| 6,286,804 | B1 | * | 9/2001 | Avinger et al. | 248/523 |
| 7,044,427 | B2 | * | 5/2006 | Eckenswiller | 248/523 |
| 7,600,342 | B2 | * | 10/2009 | Fiveash | 47/40.5 |
| 2004/0045216 | A1 | * | 3/2004 | Fiveash | 47/40.5 |
| 2005/0051695 | A1 | * | 3/2005 | Kovach | 248/524 |
| 2010/0019119 | A1 | * | 1/2010 | Hebert | 248/521 |

* cited by examiner

*Primary Examiner* — T. Nguyen
(74) *Attorney, Agent, or Firm* — Brannen Law Office, LLC

(57) ABSTRACT

The present invention relates to an adjustable high water capacity tree stand having a wide base and an increased water carrying capacity. In a preferred embodiment, the stand has a generally inverted conical shape. A plurality of base plates engage the bottom of the tree truck to prevent slipping. A plurality of compression assemblies are also provided. The compression assemblies can move in and out relative the tree trunk under operation of a rod. The rod can be a screw rod that drives a translator, which in turn is pivotally connected to a ram. The ram is pivotally connected to an arm and causes the arm to pivot. The arm is pivotally connected to a head, and operates to selectively move the head in and out. The head, being pivotally connected to the arm, can flushly engage the tree trunk near its bottom.

15 Claims, 11 Drawing Sheets

ADJUSTABLE HIGH WATER CAPACITY TREE STAND

This utility patent application claims priority on and the benefit of provisional application 60/934,758 filed Jun. 15, 2007, the entire contents of which are hereby incorporated herein by reference.

BACKGROUND OF THE INVENTION

1. Field of the Invention

The present invention relates to an adjustable high water capacity tree stand having a wide base and an increased water carrying capacity for increased stability and also having a plurality of adjustable compression members.

2. Description of the Related Art

It is customary to display Christmas or holiday Trees. Some people have switched to fake trees in recent years. Yet, for many, there is no substitute for a real freshly cut tree. Of course, the displaying of real trees does come with some associated challenges. For example, a real tree can be non-symmetrical. Accordingly, several stands have been developed over the years to provide stability to the tree. Also, real trees require water to preserve the appearance of the tree. It is customary for a person to display the tree for a month or more. During this time, depending on the tree and other environmental conditions, the user likely needs to supply water to the tree one or more times each and every day.

The traditional tree base has an upwardly facing opening. The opening is generally able to accommodate the bottom of the tree and a small amount of water. In order to replenish the water in the base, the person must reach below the bottom branches of the tree. During this task, the user can bump the branches of the tree and potentially cause the tree to fall over, or can knock ornaments from the tree. Further, the user may spill water onto the floor, which can lead to stains, flooring damage and inconvenience.

Several patents disclose inventions that have been developed to aid in keeping the tree hydrated, or reducing the burden associated with putting water in a tree base. Some of those patents are briefly discussed below.

U.S. Pat. No. 4,930,252 to Krause et al. is titled Christmas Tree Waterer. This patent shows an apparatus for supplying water to a conventional tree stand. A monitor is positioned within the reservoir of the tree stand and is electrically connected to a solenoid valve so that water will be supplied from a water reservoir to the tree stand when the water in the tree stands drops to a predetermined level. One drawback with this design is that it requires electricity, and it does nothing to increase the stability of the convention base. Further, the reservoir is shaped such that there is an undesirably large amount of exposed water surface area, which could promote evaporation of the water of the reservoir.

U.S. Pat. No. 4,993,176 to Spinosa is titled Christmas Tree Stand Watering System. This patent shows an ornamental reservoir from which a water hose and an air hose can extend. The hoses terminate within the container of the stand. The container is filled with water. When the open end of the air hose becomes open to the atmosphere, water flows from the reservoir to the container through the water hose. The container shown in this patent is bowl shaped. A relatively large amount of water can evaporate to the atmosphere.

U.S. Pat. No. 5,020,271 to Walker is titled Watering Device. This patent shows a flexible plastic bag from which water can trickle from.

U.S. Pat. No. 5,157,868 to Munoz is titled Passive Christmas Tree Waterer and Monitor. This patent shows that a reservoir is equipped with a translucent column through which the fluid level in the system can be monitored on a continuous basis. An aperture is through the lid of the reservoir. A conduit is provided and connects the reservoir to a tree stand. The sidewalls of the illustrated tree stand are generally vertical, and as such do not prevent evaporation of the water to the atmosphere.

U.S. Pat. No. 5,369,910 to Copenhaver is titled Christmas Tree Stand with Remote Watering System. This patent has a remote watering box that resembles a wrapped gift. Water can run through tubing under a tree skirt. This patent shows a tree stand with generally vertical sidewalls. The stand does nothing to limit exposed water surface area and accordingly reduce evaporation.

U.S. Pat. No. 5,446,993 to Cullen is titled Watering System for Plants. This patent teaches the use of a tubular device having one end enlarged to have a funnel like receptacle. Water is received within the funnel and delivered to the pot or stand. A band hooked around the base of the tree supports the system. The pot shown in this patent is generally bowl shaped, and a relatively large amount of surface area between the water and the atmosphere is present.

U.S. Pat. No. 5,473,837 to Skoczylas et al. is titled Water Level Maintenance System. This patent shows a device for maintaining a water level within a reservoir. The inventive device is said to include a pump. A switch responsive to the water level communicates with the pump to effect energization thereof as the water level declines.

U.S. Pat. No. 5,493,277 to Pierce et al. is titled Device for Monitoring the Water Level of a Container and For Adding Water to the Container. Water can be added to the tree through a funnel side. Red and green LED's are provided for indicating whether water is needed or not.

U.S. Pat. No. 5,513,677 to McCurry is titles Remote Fill Receptacle. This patent shows a receptacle body and a receptacle conduit for filling a tree stand. The tree stand is shown to be bowl shaped.

The traditional tree stand typically uses screws to engage the base of the trunk to hold the tree in an upright position. The screws have a generally low surface area, and the screws typically penetrate the tree bark. One disadvantage is that the screws need to be tightened one or more times, as the areas of the tree surrounding the penetration can become soft.

None of the above-patents show a reservoir that is large enough to contain enough water for many days, up to an entire season.

None of the above-patents show a reservoir having a neck smaller than the remainder of the reservoir to reduce evaporation.

None of the above-patents show a reservoir having a body that extends water to the perimeter of the base to aid in providing stability to the tree.

None of the above-patents show a plurality of high surface area compression members designed to engage a wide variety of tree trunk sizes.

None of the above-patents show a plurality of base plates designed to aggressively engage the base of the tree to prevent slippage, as accomplished in the present invention.

Thus there exists a need for a tree stand that solves these and other problems.

SUMMARY OF THE INVENTION

The present invention relates to an adjustable high water capacity tree stand having a wide base and an increased water carrying capacity for increased stability and also having a plurality of adjustable compression members. In a preferred embodiment, the stand has a generally inverted conical shape. A plurality of base plates can be provided for engaging the bottom of the tree truck to prevent the bottom of the tree trunk from slipping. A plurality of compression assemblies can also be provided. The compression assemblies can move in and out relative the tree trunk under operation of a rod. In the preferred embodiment, the rod can be a screw rod that drives a translator, which in turn is pivotally connected to a ram. The ram is pivotally connected to an arm and causes the arm to pivot. The arm is pivotally connected to a head, and operates to selectively move the head in and out. The head, being pivotally connected to the arm, can flushly engage the tree trunk near its bottom.

According to one advantage of the present invention, the reservoir is designed to hold enough water for many days, and even up to an entire display season. In this regard, the reservoir may be designed to accommodate approximately 15 gallons of water. Having enough water for the entire display season eliminates the need to crawl under the tree to refill the reservoir every day.

According to another advantage of the present invention, a hole in the top surface of the tree that is designed to receive the tree is relatively small compared to the overall diameter of the water carrying portion of the reservoir. Hence, there is limited surface area of water in contact with the atmosphere when a tree is received within the reservoir. Advantageously, the water has limited availability to evaporate. Therefore, the water that is present in the reservoir remains available to hydrate the tree.

According to a further advantage of the present invention, the periphery of the bottom of the reservoir is relatively large. In contrast to having four beams provide support, the present invention provides support and resistance to tipping equally in all directions. The support is enhanced when water is added to the reservoir, as the weight of the water helps maintain the low center of gravity of the stand, and increase the stand's resistance to tipping.

According to a still further advantage of the present invention, a plurality of high surface area compression assemblies is provided. Each of the high surface area compression assemblies has a head that selectively engages the outside of the tree trunk to provide stability to the tree. Further, the compression members have a head that is pivotally connected to the remainder of the respective compression assembly. The pivotal connections allow the head to engage the tree trunk in a flush manner, maximizing surface area contact.

According to a still further advantage yet of the present invention, the stand has a plurality of base plates. The base plates can be wedge shaped and can have side walls with teeth to aggressively engage the base of the tree trunk. The side walls can have increasing height moving away from the center of the reservoir, increasing the effectiveness of the teeth.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
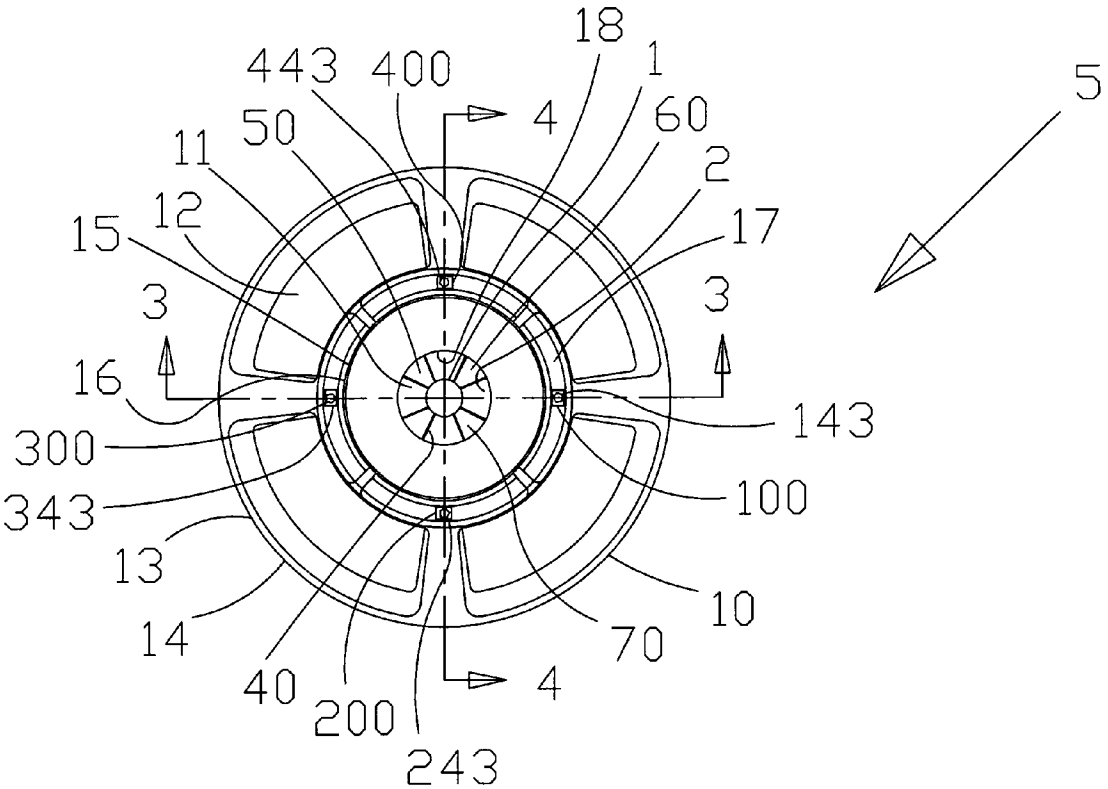
FIG. 1 is a top view of a preferred embodiment of the present invention.
Figure 2:
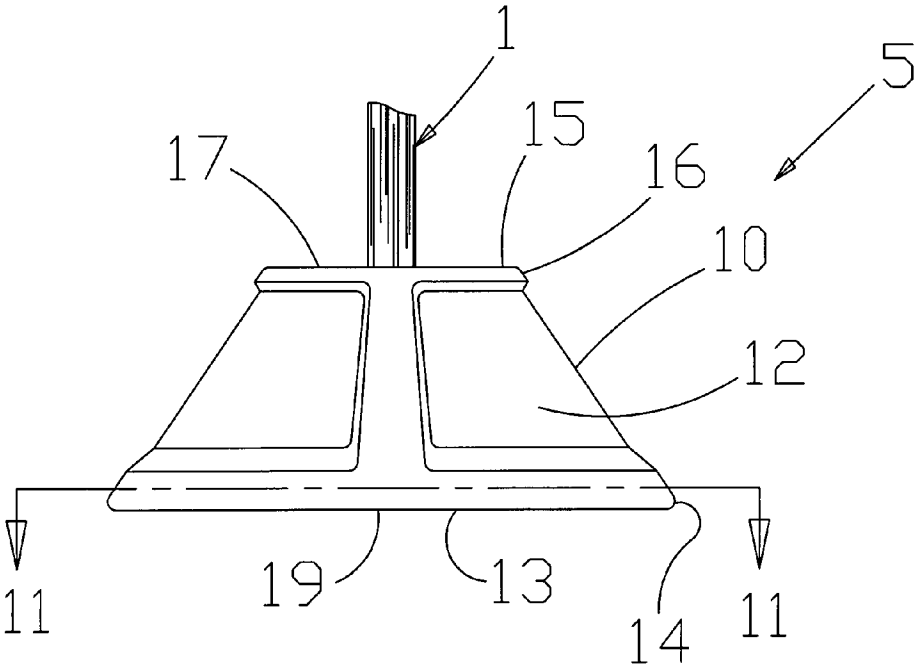
FIG. 2 is a side view of the embodiment shown in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention comprises a stand 5 used to hold a tree 1 in an upright orientation and provide water 2 to hydrate the tree 1 during the season of display.

Looking now to FIGS. 1-4, it is illustrated that the tree stand 5 comprises a reservoir 10 for holding a selected amount of water 2. The reservoir can be constructed of a plastic, metal or other suitable material. It is appreciated that many materials could be utilized without departing from the broad aspects of the present invention. The reservoir 10 has an inside 11 and an outside 12. The reservoir has a bottom 13 with a periphery 14. The periphery 14 is preferably circular in shape, and has a reservoir center centrally located within the periphery 14. However other shapes could alternatively be used without departing from the broad aspects of the present invention. The periphery can have a diameter of approximately between 10 and 30 inches. It is appreciated that the larger the diameter of the periphery 14, the more stable the stand 5 may be.

The reservoir 10 further has a top 15 with an associated top periphery 16. The top periphery is preferably circular in shape, and can have a diameter of approximately 3 to 10 inches. An upper surface 17 is provided between the top 15 and the bottom 13. The upper surface preferably has a hole 18 there through. A bottom surface 19 is provided. The bottom surface is preferably flat and has perimeter dimensions the same as the periphery 14 at the bottom 13.

The reservoir 10 can be described as having an internal volume defined by a shape generally resembling an inverted cone. Yet, it is understood that the internal shape can vary without departing from the broad aspects of the present invention.

Figure 11:
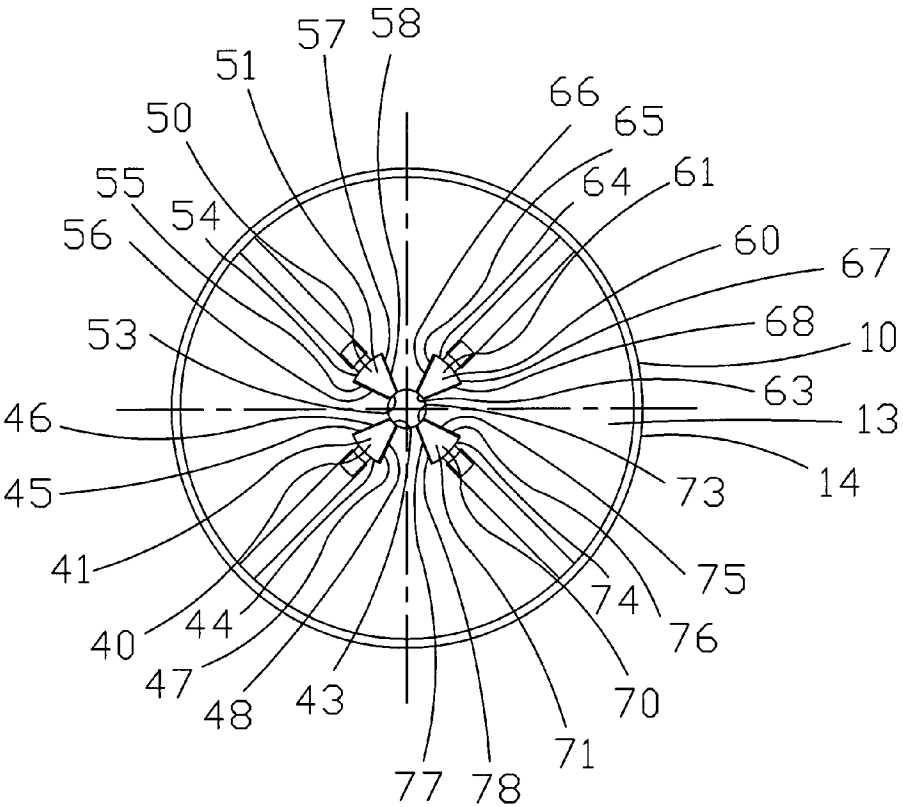
FIG. 11 is a sectional view taken along line 11-11 in FIG. 2.

Looking now at FIGS. 1 and 11, it is seen that a base plate 40 is provided. The base plate 40 can be made of metal, plastic or other suitably rigid and strong material. The base plate 40 is connected to and stationary relative the bottom 13 of the reservoir. In the preferred embodiment, the base plate 40 is in a snap fitting engagement with the reservoir bottom 13. The base plate 40 has a top 41 and a bottom (not shown). The plate 40 further has a first end 43 near the center of the bottom plate, and a second end 44 remote from the first end 43. The plate 40 is preferably wedge shaped, having an increasing with between a first edge and a second edge. In this regard, the width of the plate 40 increases as determined by increased distance from the center of the reservoir bottom. A first side wall 45 is provided having teeth 46 on the upper edge of the wall. The side wall 45 has a rising profile as measured in height as determined at increasing distances from the center of the reservoir bottom. A second side wall 47 is further provided having teeth 48 on the upper edge of the wall. The second side wall 47 is identical in profile to the first side wall. The first wall 45 and second wall 47 define divergent lines away from the center of the reservoir bottom.

Figure 3:
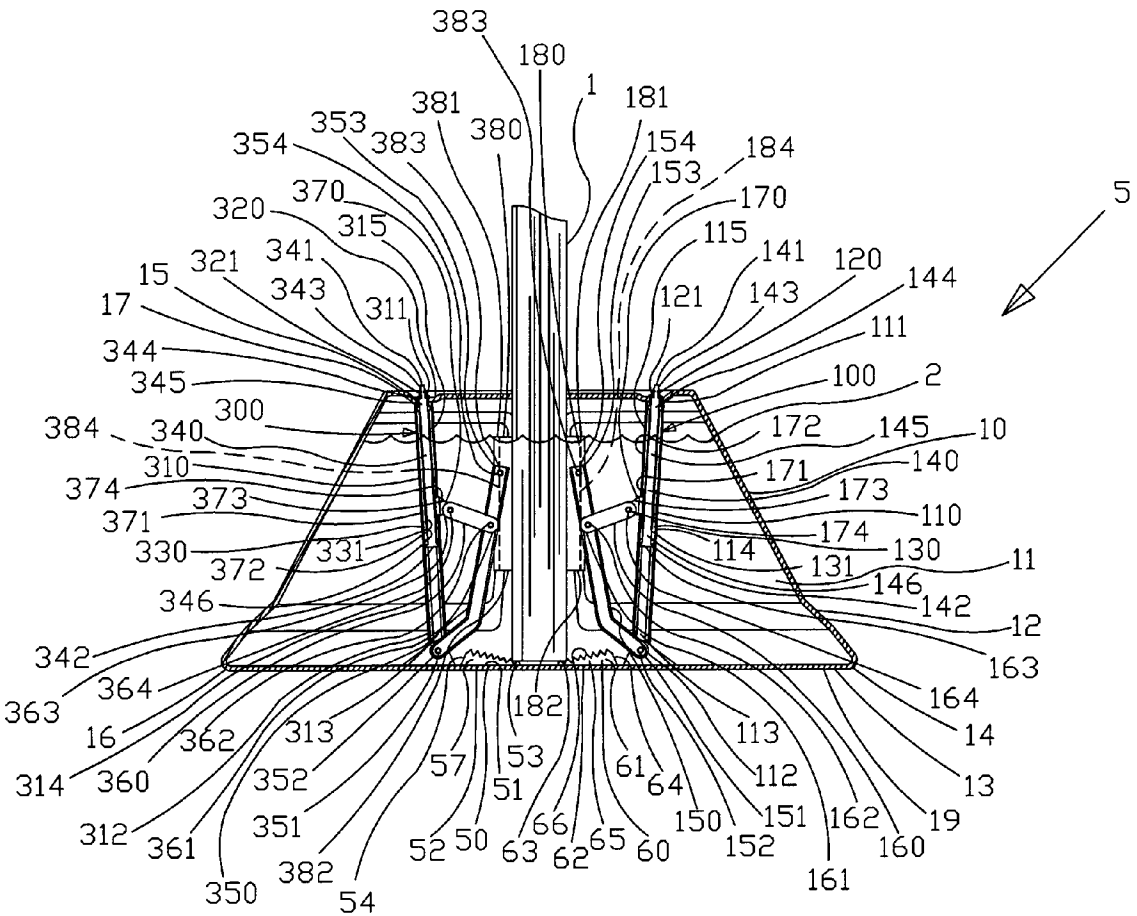
FIG. 3 is a sectional view taken along line 3-3 in FIG. 2.

Looking now at FIGS. 1, 3 and 11, it is seen that a base plate 50 is provided. The base plate 50 can be made of metal, plastic or other suitably rigid and strong material. The base plate 50 is connected to and stationary relative the bottom 13 of the reservoir. In the preferred embodiment, the base plate 50 is in a snap fitting engagement with the reservoir bottom 13. The base plate 50 has a top 51 and a bottom 52. The plate 50 further has a first end 53 near the center of the bottom plate, and a second end 54 remote from the first end 53. The plate 50 is preferably wedge shaped, having an increasing with between a first edge and a second edge. In this regard, the width of the plate 50 increases as determined by increased distance from the center of the reservoir bottom. A first side wall 55 is provided having teeth 56 on the upper edge of the wall. The side wall 55 has a rising profile as measured in height as determined at increasing distances from the center of the reservoir bottom. A second side wall 57 is further provided having teeth 58 on the upper edge of the wall. The second side wall 57 is identical in profile to the first side wall. The first wall 55 and second wall 57 define divergent lines away from the center of the reservoir bottom.

Looking now at FIGS. 1, 3, 4 and 11, it is seen that a base plate 60 is provided. The base plate 60 can be made of metal, plastic or other suitably rigid and strong material. The base plate 60 is connected to and stationary relative the bottom 13 of the reservoir. In the preferred embodiment, the base plate 60 is in a snap fitting engagement with the reservoir bottom 13. The base plate 60 has a top 61 and a bottom 62. The plate 60 further has a first end 63 near the center of the bottom plate, and a second end 64 remote from the first end 63. The plate 60 is preferably wedge shaped, having an increasing with between a first edge and a second edge. In this regard, the width of the plate 60 increases as determined by increased distance from the center of the reservoir bottom. A first side wall 65 is provided having teeth 66 on the upper edge of the wall. The side wall 65 has a rising profile as measured in height as determined at increasing distances from the center of the reservoir bottom. A second side wall 67 is further provided having teeth 68 on the upper edge of the wall. The second side wall 67 is identical in profile to the first side wall. The first wall 65 and second wall 67 define divergent lines away from the center of the reservoir bottom.

Figure 4:
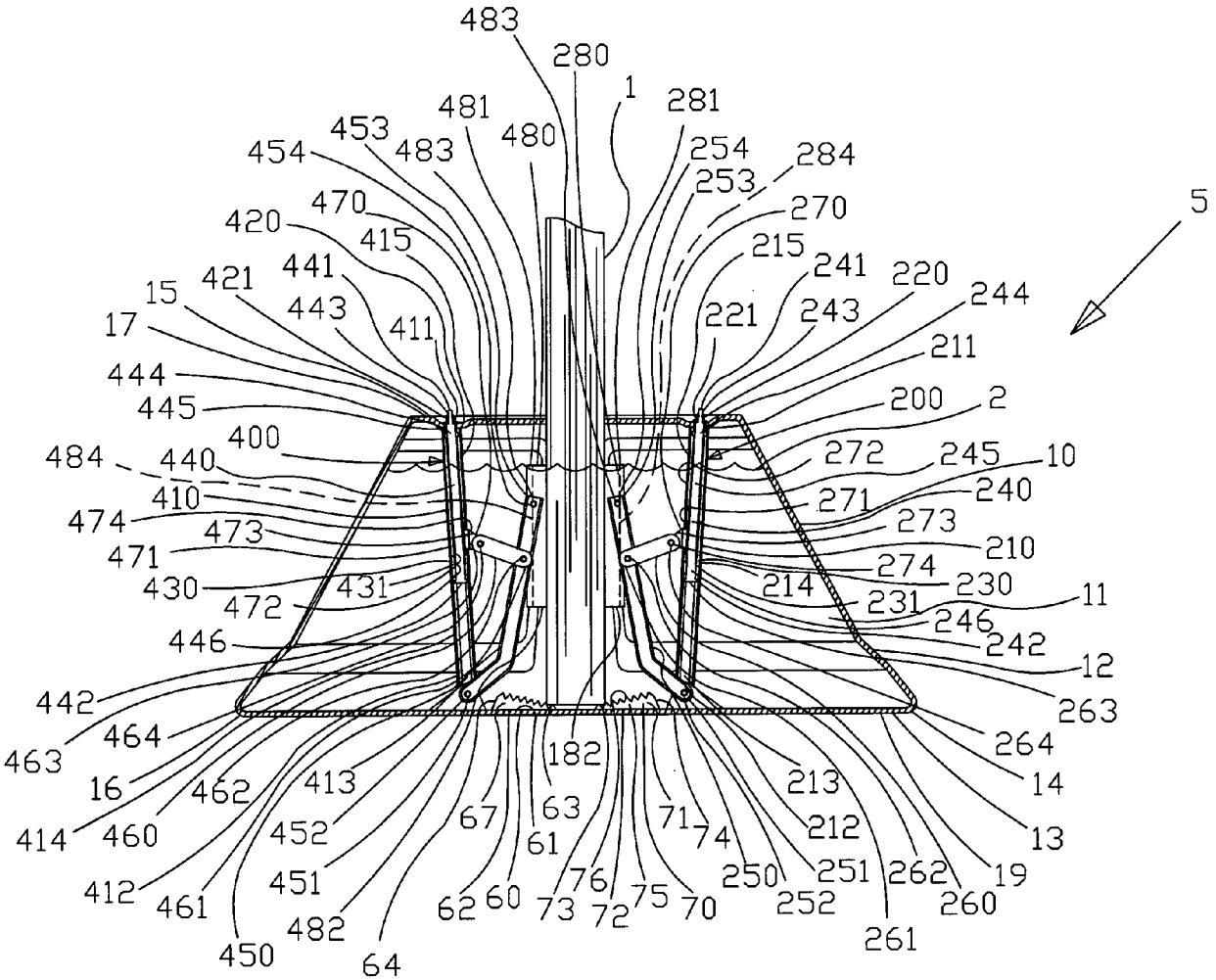
FIG. 4 is a sectional view taken along line 4-4 in FIG. 2.
Figure 5:
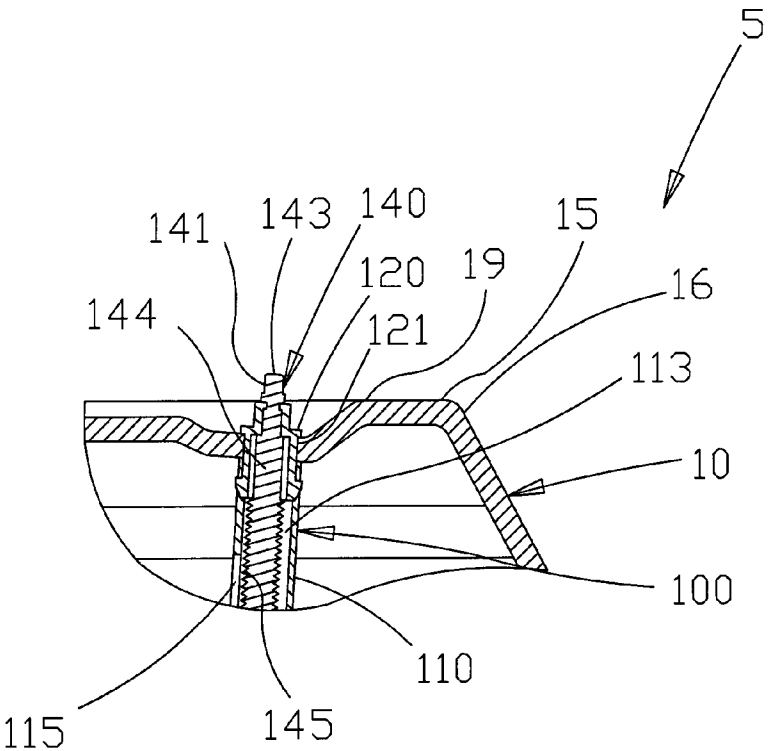
FIG. 5 is a close up view showing the top of an embodiment of a rod of the present invention.

Looking now at FIGS. 1, 4 and 11, it is seen that a base plate 70 is provided. The base plate 70 can be made of metal, plastic or other suitably rigid and strong material. The base plate 70 is connected to and stationary relative the bottom 13 of the reservoir. In the preferred embodiment, the base plate 70 is in a snap fitting engagement with the reservoir bottom 13. The base plate 70 has a top 71 and a bottom 72. The plate 70 further has a first end 73 near the center of the bottom plate, and a second end 74 remote from the first end 73. The plate 70 is preferably wedge shaped, having an increasing with between a first edge and a second edge. In this regard, the width of the plate 70 increases as determined by increased distance from the center of the reservoir bottom. A first side wall 75 is provided having teeth 76 on the upper edge of the wall. The side wall 75 has a rising profile as measured in height as determined at increasing distances from the center of the reservoir bottom. A second side wall 77 is further provided having teeth 78 on the upper edge of the wall. The second side wall 77 is identical in profile to the first side wall. The first wall 75 and second wall 77 define divergent lines away from the center of the reservoir bottom.

Each of the base plates 40, 50, 60 and 70 preferably have identical structures, and are equidistantly spaced apart. It is understood that more or less than four plates can be provided without departing from the broad aspects of the present invention. In one alternative embodiment (not shown) a single plate can be provided having multiple toothed walls having rising profiles.

It is understood that each wall of each plate 40, 50, 60 and 70, respectively, converge towards the center of the reservoir bottom, as seen in FIGS. 1 and 11. Each of the increasing base plate profiles and the teeth act to securely hold the bottom of a tree in the intended position and prevent slipping of the bottom of the tree.

Turning now generally to FIGS. 3-10, it is seen that several vies of various compression members are illustrated. In the preferred embodiment, each compression member is an assembly, or compression assembly. Four compression members 100, 200, 300 and 400 are illustrated. However, it is understood that more or fewer members may be used without departing from the broad aspects of the present invention. Specifically, due the head design (described below) there may be as few as two members and still provide the required amount of stability to the tree. The compression members are illustrated to be manually operated. It is understood that the stand 5 can be outfitted with electronics to electrically manipulate the compression assemblies.

Turning now to FIG. 3 in particular, a preferred embodiment of compression member 100 is illustrated. The compression member has a stationary bracket 110, a cap 120, a retainer 130, a rod 140, an arm 150, a ram 160, a translator 170 and a head 180. Each of these components is described below.

The stationary bracket 110 has an end 111 and an opposed end 112. Further, the bracket 110 has an interior 113 and an exterior 114. The bracket is preferably square or rectangular. Yet, the bracket could be other shapes without departing from the broad aspects of the present invention. The inside of the bracket 110 has a slot 115 formed in the upper portion of the bracket 110. The bracket first end 111 is stationarily positioned at the top 15 of the reservoir. The bracket second end 112 is stationarily positioned at the bottom 13 of the reservoir. The bracket preferably has a near vertical orientation within the reservoir.

The cap 120 has a collar 121. The cap 120 is preferably snap fit into the first end 111 of the bracket 110. The collar 121 engages an unthreaded portion 144 of a screw rod 140, as described below.

The retainer 130 also has a collar 131. The retainer 130 is preferably housed within the stationary bracket 110. Collar 131 engages a second unthreaded portion 146 of the rod 140, as described below.

The rod 140, or screw rod, has a first end 141 and a second end 142. Rod 140 has a longitudinal axis. A head 143 provided at the first end 141 of the rod 140. The head can be a hexagonal shaped head adapted to be manipulated with a standard ratcheting socket. Alternatively, the head can be shaped to receive a screw driver head. An unthreaded portion 144 is located near the head 143. The unthreaded portion 144 is engaged by the collar 121 of cap 120. In this engagement, the cap 120 provides lateral stability to the rod 140, prevents movement of the rod 140 in a direction along its longitudinal axis, yet does not inhibit rotation of the rod 140 (i.e. there is no translation of the rod 140 relative the cap 120.) A threaded portion 145 is provided preferably along a majority of the length of the rod. The threaded portion can be threaded with any desired size and pitch of threads. A second unthreaded portion 146 is provided at or near the second end 142 of the rod 140. The second unthreaded portion 146 is engaged by the collar 131 of the retainer 130. In this engagement, the retainer 130 provides lateral stability to the rod 140, prevents movement of the rod 140 in a direction along its longitudinal axis, yet does not inhibit rotation of the rod 140 (i.e. there is no translation of the rod 140 relative the retainer 130.)

The arm 150 has a first end 151 with a pivot 152, and a second end 153 with a pivot 154. Pivots 152 and 154 can be holes adapted to receive pins, bolts or other objects suitable for pivotal connections. The arm is an angled arm, or boomerang shaped arm, in the preferred embodiment. It is understood that other arm shapes can be utilized without departing from the broad aspects of the present invention. The first end 151 is pivotally connected to the bottom end of the stationary shaft. In this regard, the location of the pivot 152 is constant during operation of the compression member 100.

The ram 160 has a first end 161 with a pivot 162, and a second end 163 with a pivot 164. The first end 161 of the ram 160 is pivotally connected to the arm 150. It is preferred that the end 161 is pivotally connected to the arm 150 at a distance between the ends 151 and 153.

Figure 10:
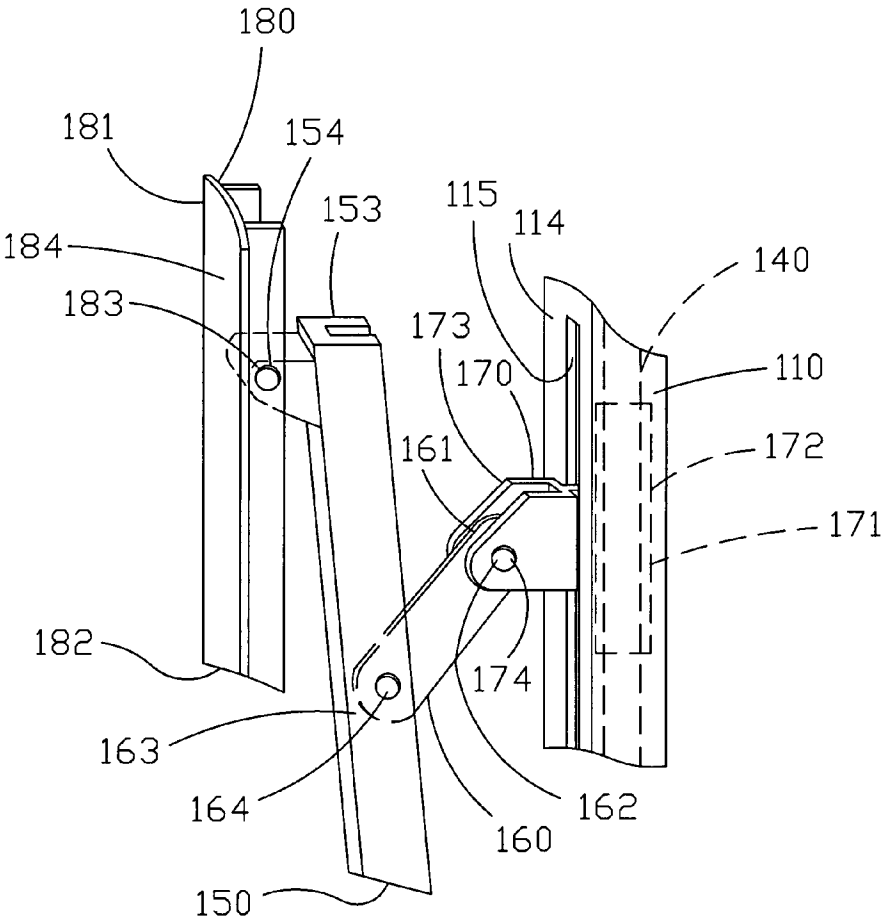
FIG. 10 is an isolated perspective view of an end of the translator extending through a slot of a vertical bracket.

The translator 170 has an end 171 that is threaded with threads 172, and a second end 173 that has a pivot 174. The threaded end is received within the stationary bracket 110, and in particular is in threadable engagement with the threaded portion 145 of the rod 140. The threaded end 171 is prevented from rotating within the bracket 110. One preferred structure to prevent the rotation is the use of fins. However, other structures could alternatively be used without departing from the broad aspects of the present invention. In this regard, the translator 170 translates (moves) in a selected direction (preferably up or down) under selected operation of the screw rod 140. The second end 173 of the translator 170 protrudes from the bracket 110 by passing through the slot 115, as seen in FIG. 10. The second end 173 of the translator is pivotally connected to the second end 163 of the ram, at pivots 174 and 164, respectively.

Figure 6:
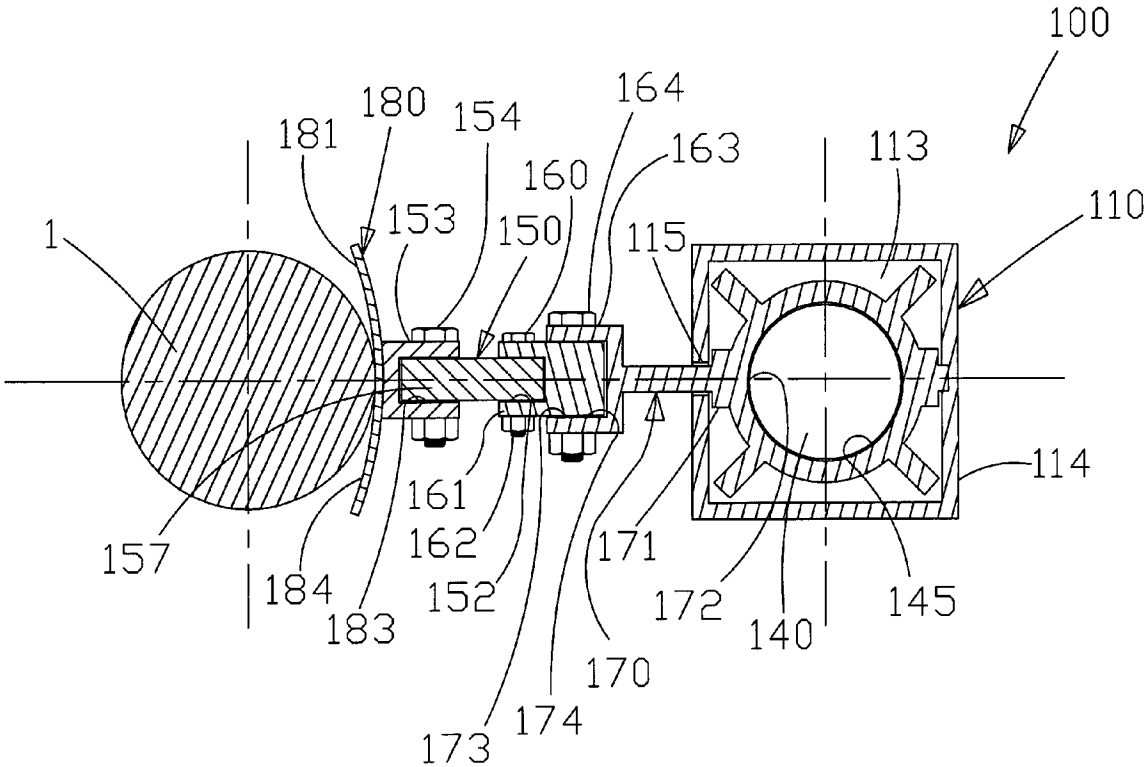
FIG. 6 is a top isolated view showing an embodiment of the head of the present invention engaging a two inch tree.
Figure 7:
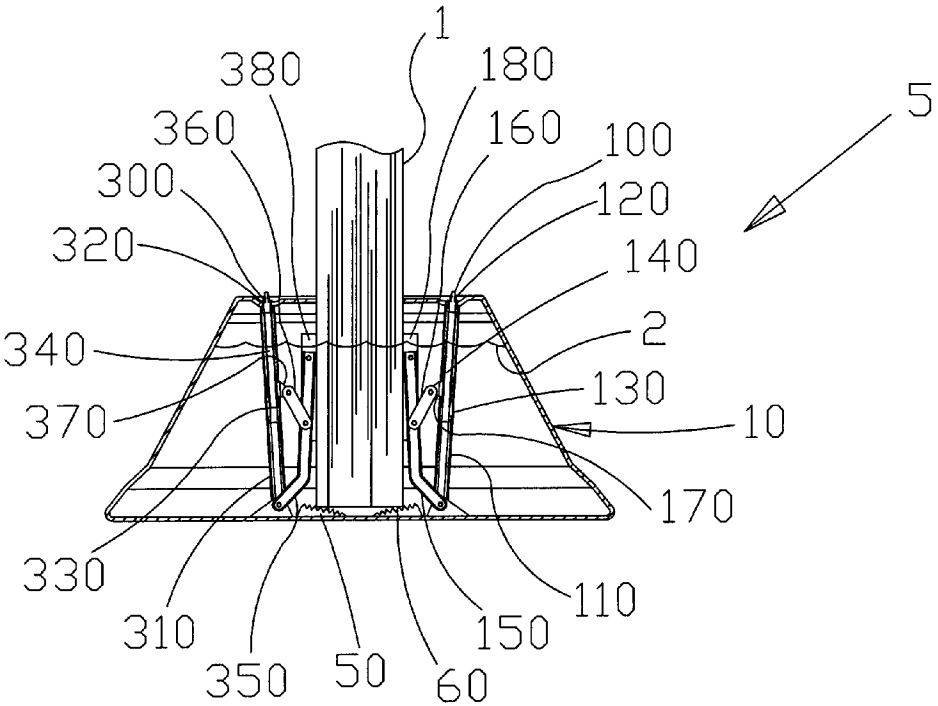
FIG. 7 is similar to FIG. 3, but shows the stand receiving a six inch trunk.
Figure 8:
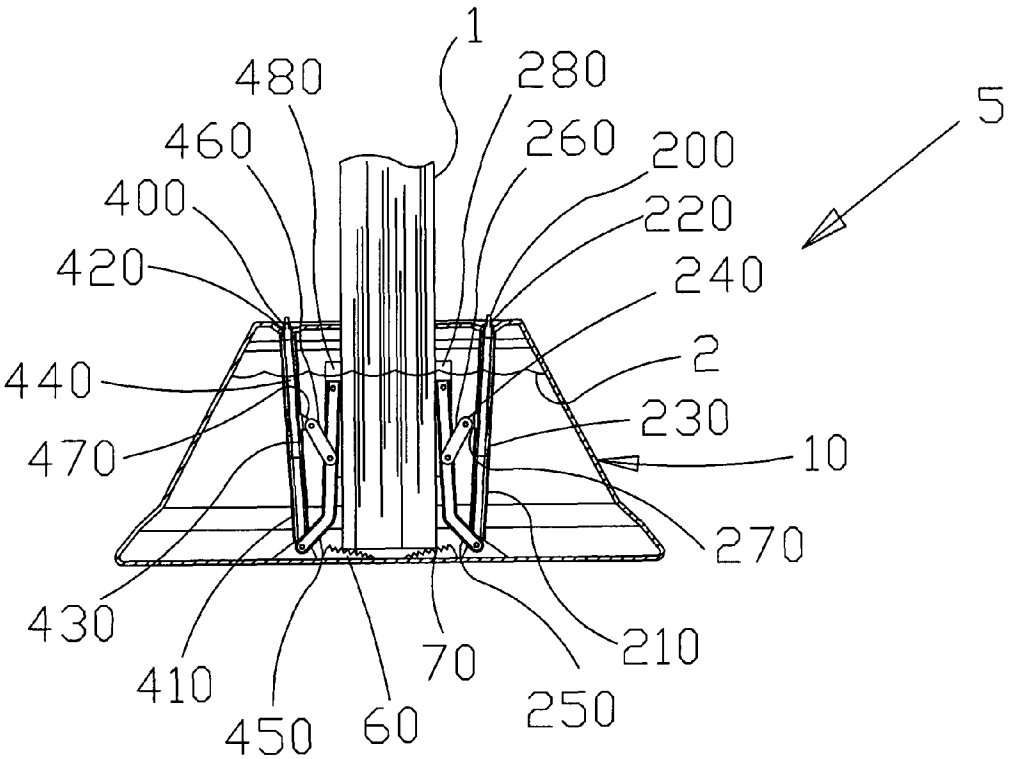
FIG. 8 is similar to FIG. 4, but shows the stand receiving a six inch trunk.
Figure 9:
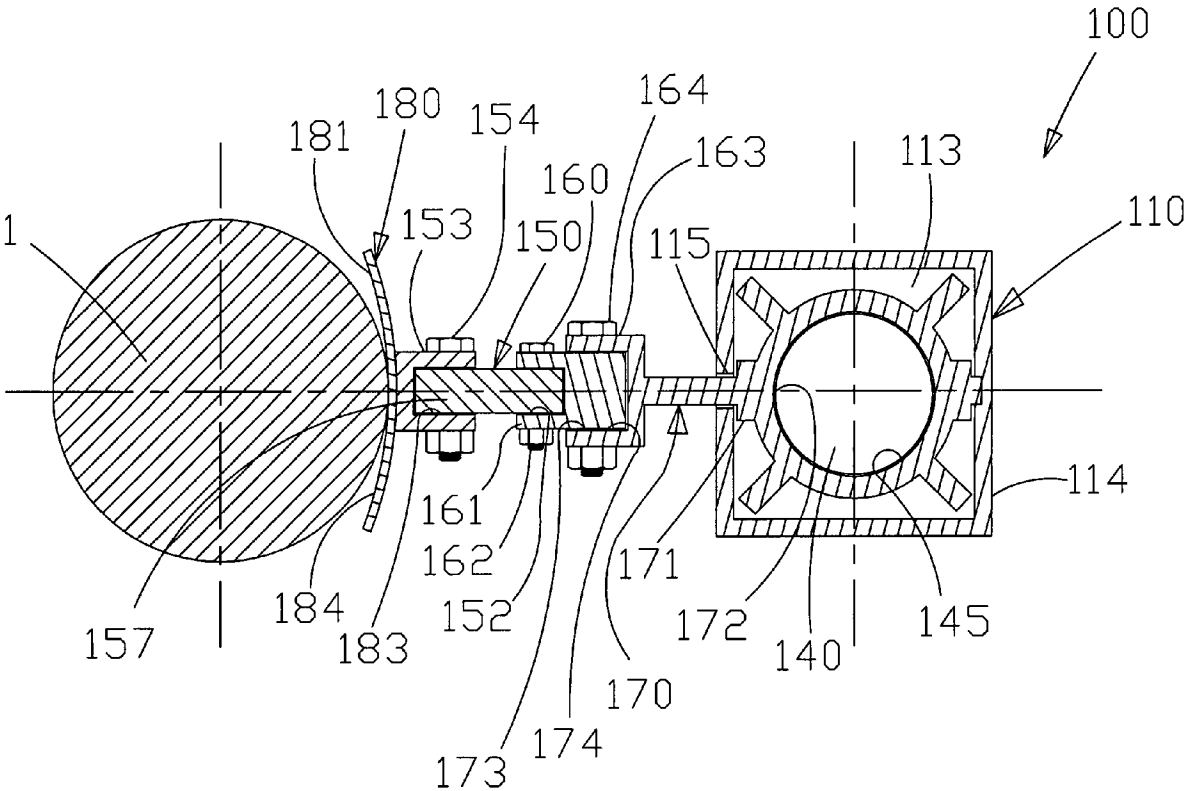
FIG. 9 is a top isolated view showing the head engaging a six inch trunk.

The head 180 has a top 181, a bottom 182, a pivot 183 and a face 184. The head has a height, preferably between four and six inches between the top 181 and bottom 182. The head 180 is pivotally connected to the second end 153 of the arm 150. The single pivotal connection between the head 180 and arm 150 allows the head to rotate, if necessary, to flushly engage the tree while applying a compressive force. The face 184 is preferably concave, and as such can accommodate tree sizes of at least between two and six inches, as seen in FIGS. 6 and 9.

Turning now to operation of the compression assembly 100, it is understood in a broad sense that turning the screw rod 140 in a selected rotational direction from the top 15 of the reservoir will cause the head 180 to selectably move in or out relative the tree in a direction that is non parallel to the longitudinal axis of the rod 140. A more specific understanding can be achieved when comparing FIGS. 3 and 7. Specifically, the compression member 100 is most of the way compressed in FIG. 3 when the translator is turned most all the way towards the lower end of the threaded portion 145 of the rod 140. In this position, the ram 160 forces the second end 153 of the arm 150 to pivot away from the stationary bracket 110. As the arm 150 pivots away from the bracket 110, it moves towards the center of the reservoir 10. The head 180 moves with the arm 150, and accordingly is located close to the inner range (able to accommodate the smallest diameter tree). Now in FIG. 7, it is seen that the translator 170 is relatively near the top of the bracket, and the arm is retracted towards the bracket to accommodate a tree with a larger trunk diameter.

Turning now to FIG. 4 in particular, a preferred embodiment of a second compression member 200 is illustrated. The second compression member has a stationary bracket 210, a cap 220, a retainer 230, a rod 240, an arm 250, a ram 260, a translator 270 and a head 280. Each of these components is described below. The second compression member 200 preferably identical in structure as the first compression member 100.

The stationary bracket 210 has an end 211 and an opposed end 212. Further, the bracket 210 has an interior 213 and an exterior 214. The bracket is preferably square or rectangular. Yet, the bracket could be other shapes without departing from the broad aspects of the present invention. The inward facing surface of the bracket 210 has a slot 215 formed there through in the upper portion of the bracket 210. The bracket first end 211 is stationarily positioned at the top 15 of the reservoir. The bracket second end 212 is stationarily positioned at the bottom 13 of the reservoir. The bracket preferably has a near vertical orientation within the reservoir.

The cap 220 has a collar 221. The cap 220 is preferably snap fit into the first end 211 of the bracket 210. The collar 221 engages an unthreaded portion 244 of a screw rod 240, as described below.

The retainer 230 also has a collar 231. The retainer 230 is preferably housed within the stationary bracket 210. Collar 231 engages a second unthreaded portion 246 of the rod 240, as described below.

The rod 240, or screw rod, has a first end 241 and a second end 242. Rod 240 has a longitudinal axis. A head 243 provided at the first end 241 of the rod 240. The head can be a hexagonal shaped head adapted to be manipulated with a standard ratcheting socket. Alternatively, the head can be shaped to receive a screw driver head. An unthreaded portion 244 is located near the head 243. The unthreaded portion 244 is engaged by the collar 221 of cap 220. In this engagement, the cap 220 provides lateral stability to the rod 240, prevents movement of the rod 240 in a direction along its longitudinal axis, yet does not inhibit rotation of the rod 240 (i.e. there is no translation of the rod 240 relative the cap 220.) A threaded portion 245 is provided preferably along a majority of the length of the rod. The threaded portion can be threaded with any desired size and pitch of threads. A second unthreaded portion 246 is provided at or near the second end 242 of the rod 240. The second unthreaded portion 246 is engaged by the collar 231 of the retainer 230. In this engagement, the retainer 230 provides lateral stability to the rod 240, prevents movement of the rod 240 in a direction along its longitudinal axis, yet does not inhibit rotation of the rod 240 (i.e. there is no translation of the rod 240 relative the retainer 230.)

The arm 250 has a first end 251 with a pivot 252, and a second end 253 with a pivot 254. Pivots 252 and 254 can be holes adapted to receive pins, bolts or other objects suitable for pivotal connections. The arm is an angled arm, or boomerang shaped arm, in the preferred embodiment. It is understood that other arm shapes can be utilized without departing from the broad aspects of the present invention. The first end 251 is pivotally connected to the bottom end of the stationary shaft. In this regard, the location of the pivot 252 is constant during operation of the compression member 200.

The ram 260 has a first end 261 with a pivot 262, and a second end 263 with a pivot 264. The first end 261 of the ram 260 is pivotally connected to the arm 250. It is preferred that the end 261 is pivotally connected to the arm 250 at a distance between the ends 251 and 253.

The translator 270 has an end 271 that is threaded with threads 272, and a second end 273 that has a pivot 274. The threaded end is received within the stationary bracket 210, and in particular is in threadable engagement with the threaded portion 245 of the rod 240. The threaded end 271 is prevented from rotating within the bracket 210. One preferred structure to prevent the rotation is the use of fins. However, other structures could alternatively be used without departing from the broad aspects of the present invention. In this regard, the translator 270 translates (moves) in a selected direction (preferably up or down) under selected operation of the screw rod 240. The second end 273 of the translator 270 protrudes from the bracket 210 by passing through the slot 215. The second end 273 of the translator is pivotally connected to the second end 263 of the ram, at pivots 274 and 264, respectively.

The head 280 has a top 281, a bottom 282, a pivot 283 and a face 284. The head has a height, preferably between four and six inches between the top 281 and bottom 282. The head 280 is pivotally connected to the second end 253 of the arm 250. The single pivotal connection between the head 280 and arm 250 allows the head to rotate, if necessary, to flushly engage the tree while applying a compressive force. The face 284 is preferably concave, and as such can accommodate tree sizes of at least between two and six inches.

Turning now to operation of the compression assembly 200, it is understood in a broad sense that turning the screw rod 240 in a selected rotational direction from the top 15 of the reservoir will cause the head 280 to selectably move in or out relative the tree in a direction that is non parallel to the longitudinal axis of the rod 240. A more specific understanding can be achieved when comparing FIGS. 4 and 8. Specifically, the compression member 200 is most of the way compressed in FIG. 4 when the translator is turned most all the way towards the lower end of the threaded portion 245 of the rod 240. In this position, the ram 260 forces the second end 253 of the arm 250 to pivot away from the stationary bracket 210. As the arm 250 pivots away from the bracket 210, it moves towards the center of the reservoir 10. The head 280 moves with the arm 250, and accordingly is located close to the inner range (able to accommodate the smallest diameter tree). Now in FIG. 8, it is seen that the translator 270 is relatively near the top of the bracket, and the arm is retracted towards the bracket to accommodate a tree with a larger trunk diameter.

Turning now again to FIG. 3 in particular, a preferred embodiment of a third compression member 300 is illustrated. The third compression member has a stationary bracket 310, a cap 320, a retainer 330, a rod 340, an arm 350, a ram 360, a translator 370 and a head 380. Each of these components is described below. The third compression member 300 preferably identical in structure as the first compression member 100.

The stationary bracket 310 has an end 311 and an opposed end 312. Further, the bracket 310 has an interior 313 and an exterior 314. The bracket is preferably square or rectangular. Yet, the bracket could be other shapes without departing from the broad aspects of the present invention. The inward facing surface of the bracket 310 has a slot 315 formed there through in the upper portion of the bracket 310. The bracket first end 311 is stationarily positioned at the top 15 of the reservoir. The bracket second end 312 is stationarily positioned at the bottom 13 of the reservoir. The bracket preferably has a near vertical orientation within the reservoir.

The cap 320 has a collar 321. The cap 320 is preferably snap fit into the first end 311 of the bracket 310. The collar 321 engages an unthreaded portion 344 of a screw rod 340, as described below.

The retainer 330 also has a collar 331. The retainer 330 is preferably housed within the stationary bracket 310. Collar 331 engages a second unthreaded portion 346 of the rod 340, as described below.

The rod 340, or screw rod, has a first end 341 and a second end 342. Rod 340 has a longitudinal axis. A head 343 provided at the first end 341 of the rod 340. The head can be a hexagonal shaped head adapted to be manipulated with a standard ratcheting socket. Alternatively, the head can be shaped to receive a screw driver head. An unthreaded portion 344 is located near the head 343. The unthreaded portion 344 is engaged by the collar 321 of cap 320. In this engagement, the cap 320 provides lateral stability to the rod 340, prevents movement of the rod 340 in a direction along its longitudinal axis, yet does not inhibit rotation of the rod 340 (i.e. there is no translation of the rod 340 relative the cap 320.) A threaded portion 345 is provided preferably along a majority of the length of the rod. The threaded portion can be threaded with any desired size and pitch of threads. A second unthreaded portion 346 is provided at or near the second end 342 of the rod 340. The second unthreaded portion 346 is engaged by the collar 331 of the retainer 330. In this engagement, the retainer 330 provides lateral stability to the rod 340, prevents movement of the rod 340 in a direction along its longitudinal axis, yet does not inhibit rotation of the rod 340 (i.e. there is no translation of the rod 340 relative the retainer 330.)

The arm 350 has a first end 351 with a pivot 352, and a second end 353 with a pivot 354. Pivots 352 and 354 can be holes adapted to receive pins, bolts or other objects suitable for pivotal connections. The arm is an angled arm, or boomerang shaped arm, in the preferred embodiment. It is understood that other arm shapes can be utilized without departing from the broad aspects of the present invention. The first end 351 is pivotally connected to the bottom end of the stationary shaft. In this regard, the location of the pivot 352 is constant during operation of the compression member 300.

The ram 360 has a first end 361 with a pivot 362, and a second end 363 with a pivot 364. The first end 361 of the ram 360 is pivotally connected to the arm 350. It is preferred that the end 361 is pivotally connected to the arm 350 at a distance between the ends 351 and 353.

The translator 370 has an end 371 that is threaded with threads 372, and a second end 373 that has a pivot 374. The threaded end is received within the stationary bracket 310, and in particular is in threadable engagement with the threaded portion 345 of the rod 340. The threaded end 371 is prevented from rotating within the bracket 310. One preferred structure to prevent the rotation is the use of fins. However, other structures could alternatively be used without departing from the broad aspects of the present invention. In this regard, the translator 370 translates (moves) in a selected direction (preferably up or down) under selected operation of the screw rod 340. The second end 373 of the translator 370 protrudes from the bracket 310 by passing through the slot 315. The second end 373 of the translator is pivotally connected to the second end 363 of the ram, at pivots 374 and 364, respectively.

The head 380 has a top 381, a bottom 382, a pivot 383 and a face 384. The head has a height, preferably between four and six inches between the top 381 and bottom 382. The head 380 is pivotally connected to the second end 353 of the arm 350. The single pivotal connection between the head 380 and arm 350 allows the head to rotate, if necessary, to flushly engage the tree while applying a compressive force. The face 384 is preferably concave, and as such can accommodate tree sizes of at least between two and six inches.

Turning now to operation of the compression assembly 300, it is understood in a broad sense that turning the screw rod 340 in a selected rotational direction from the top 15 of the reservoir will cause the head 380 to selectably move in or out relative the tree in a direction that is non parallel to the longitudinal axis of the rod 340. A more specific understanding can be achieved when comparing FIGS. 3 and 7. Specifically, the compression member 300 is most of the way compressed in FIG. 3 when the translator is turned most all the way towards the lower end of the threaded portion 345 of the rod 340. In this position, the ram 360 forces the second end 353 of the arm 350 to pivot away from the stationary bracket 310. As the arm 350 pivots away from the bracket 310, it moves towards the center of the reservoir 10. The head 380 moves with the arm 350, and accordingly is located close to the inner range (able to accommodate the smallest diameter tree). Now in FIG. 7, it is seen that the translator 370 is relatively near the top of the bracket, and the arm is retracted towards the bracket to accommodate a tree with a larger trunk diameter.

Turning now again to FIG. 4 in particular, a preferred embodiment of a fourth compression member 400 is illustrated. The fourth compression member has a stationary bracket 410, a cap 420, a retainer 430, a rod 440, an arm 450, a ram 460, a translator 470 and a head 480. Each of these components is described below. The fourth compression member 400 preferably identical in structure as the first compression member 100.

The stationary bracket 410 has an end 411 and an opposed end 412. Further, the bracket 410 has an interior 413 and an exterior 414. The bracket is preferably square or rectangular. Yet, the bracket could be other shapes without departing from the broad aspects of the present invention. The inward facing surface of the bracket 410 has a slot 415 formed there through in the upper portion of the bracket 410. The bracket first end 411 is stationarily positioned at the top 15 of the reservoir. The bracket second end 412 is stationarily positioned at the bottom 13 of the reservoir. The bracket preferably has a near vertical orientation within the reservoir.

The cap 420 has a collar 421. The cap 420 is preferably snap fit into the first end 411 of the bracket 410. The collar 421 engages an unthreaded portion 444 of a screw rod 440, as described below.

The retainer 430 also has a collar 431. The retainer 430 is preferably housed within the stationary bracket 410. Collar 431 engages a second unthreaded portion 446 of the rod 440, as described below.

The rod 440, or screw rod, has a first end 441 and a second end 442. Rod 440 has a longitudinal axis. A head 443 provided at the first end 441 of the rod 440. The head can be a hexagonal shaped head adapted to be manipulated with a standard ratcheting socket. Alternatively, the head can be shaped to receive a screw driver head. An unthreaded portion 444 is located near the head 443. The unthreaded portion 444 is engaged by the collar 421 of cap 420. In this engagement, the cap 420 provides lateral stability to the rod 440, prevents movement of the rod 440 in a direction along its longitudinal axis, yet does not inhibit rotation of the rod 440 (i.e. there is no translation of the rod 440 relative the cap 420.) A threaded portion 445 is provided preferably along a majority of the length of the rod. The threaded portion can be threaded with any desired size and pitch of threads. A second unthreaded portion 446 is provided at or near the second end 442 of the rod 440. The second unthreaded portion 446 is engaged by the collar 431 of the retainer 430. In this engagement, the retainer 430 provides lateral stability to the rod 440, prevents movement of the rod 440 in a direction along its longitudinal axis, yet does not inhibit rotation of the rod 440 (i.e. there is no translation of the rod 440 relative the retainer 430.)

The arm 450 has a first end 451 with a pivot 452, and a second end 453 with a pivot 454. Pivots 452 and 454 can be holes adapted to receive pins, bolts or other objects suitable for pivotal connections. The arm is an angled arm, or boomerang shaped arm, in the preferred embodiment. It is understood that other arm shapes can be utilized without departing from the broad aspects of the present invention. The first end 451 is pivotally connected to the bottom end of the stationary shaft. In this regard, the location of the pivot 452 is constant during operation of the compression member 400.

The ram 460 has a first end 461 with a pivot 462, and a second end 463 with a pivot 464. The first end 461 of the ram 460 is pivotally connected to the arm 450. It is preferred that the end 461 is pivotally connected to the arm 450 at a distance between the ends 451 and 453.

The translator 470 has an end 471 that is threaded with threads 472, and a second end 473 that has a pivot 474. The threaded end is received within the stationary bracket 410, and in particular is in threadable engagement with the threaded portion 445 of the rod 440. The threaded end 471 is prevented from rotating within the bracket 410. One preferred structure to prevent the rotation is the use of fins. However, other structures could alternatively be used without departing from the broad aspects of the present invention. In this regard, the translator 470 translates (moves) in a selected direction (preferably up or down) under selected operation of the screw rod 440. The second end 473 of the translator 470 protrudes from the bracket 410 by passing through the slot 415. The second end 473 of the translator is pivotally connected to the second end 463 of the ram, at pivots 474 and 464, respectively.

The head 480 has a top 481, a bottom 482, a pivot 483 and a face 484. The head has a height, preferably between four and six inches between the top 481 and bottom 482. The head 480 is pivotally connected to the second end 453 of the arm 450. The single pivotal connection between the head 480 and arm 450 allows the head to rotate, if necessary, to flushly engage the tree while applying a compressive force. The face 484 is preferably concave, and as such can accommodate tree sizes of at least between two and six inches.

Turning now to operation of the compression assembly 400, it is understood in a broad sense that turning the screw rod 440 in a selected rotational direction from the top 15 of the reservoir will cause the head 480 to selectably move in or out relative the tree in a direction that is non parallel to the longitudinal axis of the rod 440. A more specific understanding can be achieved when comparing FIGS. 4 and 8. Specifically, the compression member 400 is most of the way compressed in FIG. 4 when the translator is turned most all the way towards the lower end of the threaded portion 445 of the rod 440. In this position, the ram 460 forces the second end 453 of the arm 450 to pivot away from the stationary bracket 410. As the arm 450 pivots away from the bracket 410, it moves towards the center of the reservoir 10. The head 480 moves with the arm 450, and accordingly is located close to the inner range (able to accommodate the smallest diameter tree). Now in FIG. 8, it is seen that the translator 470 is relatively near the top of the bracket, and the arm is retracted towards the bracket to accommodate a tree with a larger trunk diameter.

It is appreciated that the plurality of compression members work together to maintain the tree in the preferred position.

Thus it is apparent that there has been provided, in accordance with the invention, an adjustable high water capacity tree stand that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A tree stand for holding a tree in an upright position and comprising:

a reservoir having:

a top with an opening there through for receiving the tree, the top having a top perimeter;

a bottom having a bottom perimeter, said bottom perimeter being larger than said top perimeter, wherein said reservoir has an internal volume generally defined as having a greater cross sectional area at said bottom of said reservoir than at said top of said reservoir;

at least one base plate engaging the bottom of the received tree; and a plurality of members engaging the side of the tree to maintain the tree in a selected orientation, wherein each of said plurality of members is a compression member and said compression member further comprises:

a screw rod;

a head;

a stationary bracket;

a ram;

an arm; and a translator, wherein:

said stationary bracket is stationary relative said reservoir;

said screw rod is rotatable within said stationary bracket;

said translator threadably engages said screw rod, whereby rotation of said screw rod causes said translator to translate upon the rotation;

said translator causes said ram to move in relation to said translator;

said arm pivots upon movement of said ram;

said head is pivotally connected to said arm, whereby said head selectably moves one of in and out in relation to the pivoting of said arm; and said screw operable to cause said head to selectably engage the tree.

2. The tree stand of claim 1 wherein said opening is circular, and has a diameter smaller than the bottom perimeter.

3. The tree stand of claim 1 wherein said at least one base plate comprises four base plates arranged equidistant from each other.

4. The tree stand of claim 1 wherein:

said bottom of said reservoir has a bottom center; and said at least one base plate comprises a wedge shaped plate having a rising profile as measured at increasing distances away from said bottom center of said bottom of said reservoir.

5. The tree stand of claim 4 wherein said at least one base plate comprises at least one toothed wall.

6. The tree stand of claim 1 wherein said head comprises a plate with a concave surface.

7. A tree stand for holding a tree in an upright position and comprising:

a reservoir receiving the tree, said reservoir having a reservoir top and a reservoir bottom;

at least one base plate engaging the bottom of the received tree; and a plurality of compression members engaging the side of the tree to maintain the tree in a selected orientation, each of said plurality of compression members comprising:

a screw rod having a first end and a second end, and a longitudinal axis, said first end protruding from said reservoir top; and a head, said head applying a compression force upon the tree in a direction not parallel to said longitudinal axis of said screw rod; and an arm having a arm first end and an arm second end, said arm first end being stationary, and said arm second end pivoting relative said arm first end under operation of said screw rod, and said arm second end being pivotally connected to said head.

8. The tree stand of claim 7 wherein said at least one base plate comprises four base plates, each of said four base plates being in snap-fitting engagement with said reservoir bottom.

9. The tree stand of claim 1, wherein:

said reservoir bottom has a bottom center; and said at least one base plate comprises a wedge shaped plate having a rising profile as measured at increasing distances away from said bottom center of said reservoir bottom.

10. The tree stand of claim 9 wherein said at least one base plate comprises at least one toothed wall.

11. The tree stand of claim 7 wherein:

said reservoir top has a top perimeter;

said reservoir bottom has a bottom perimeter, said bottom perimeter being larger than said top perimeter, wherein said reservoir has an internal volume generally defined as an inverted cone.

12. A tree stand for holding a tree in an upright position and comprising:

a reservoir receiving the tree, said reservoir having a reservoir top and a reservoir bottom, said reservoir bottom having a bottom center;

at least one base plate engaging the bottom of the received tree, wherein said at least one base plate comprises a wedge shaped plate having a rising profile as measured at increasing distances away from said bottom center of said reservoir bottom and said at least one base plate comprises at least one toothed wall; and a plurality of compression members engaging the side of the tree to maintain the tree in a selected orientation, wherein each of said compression members further comprise:

a stationary bracket;

a ram; and a translator, wherein:

said stationary bracket is stationary relative said reservoir;

said screw rod is rotatable within said stationary bracket;

said translator threadably engages said screw rod, whereby rotation of said screw rod causes said translator to translate upon the rotation;

said translator causes said ram to move in relation to said translator;

said arm pivots upon movement of said ram; and said head selectably moves one of in and out in relation to the pivoting of said arm.

13. The tree stand of claim 12 wherein said at least one base plate comprises four base plates, each of said base plates being directly connected to said reservoir bottom.

14. The tree stand of claim 12 wherein each of said plurality of compression members comprises:

a screw rod having a first end and a second end, and a longitudinal axis, said first end protruding from said reservoir top; and a head, said head applying a compression force upon the tree in a direction not parallel to said longitudinal axis of said screw rod.

15. The tree stand of claim 12 wherein:

said reservoir top has a top perimeter;

said reservoir bottom has a bottom perimeter, said bottom perimeter being larger than said top perimeter, wherein said reservoir has an internal volume generally defined as an inverted cone.

* * * * *